United States Patent [19]

Barber

[11] 4,161,989

[45] Jul. 24, 1979

[54] RECIPROCATING HYDRAULIC MOTORS

[75] Inventor: Antony D. Barber, Truro, England

[73] Assignee: CompAir Construction & Mining Limited, Camborne, England

[21] Appl. No.: 839,190

[22] Filed: Oct. 4, 1977

[30] Foreign Application Priority Data

Aug. 10, 1976 [GB] United Kingdom ..... 41967/76

[51] Int. Cl.[2] ..... B25D 9/00

[52] U.S. Cl. ..... 173/105; 173/134; 91/300

[58] Field of Search ..... 173/105, 104, 134, 135, 173/136, 137, 138, 116; 91/234, 299, 300

[56] References Cited

U.S. PATENT DOCUMENTS

| | | | |
|---|---|---|---|
| 3,044,452 | 7/1962 | McCrory et al. | 173/134 |
| 3,055,441 | 9/1962 | Morrison | 173/134 |
| 3,780,622 | 12/1973 | Vogel | 91/300 |
| 4,028,995 | 6/1977 | Salmi et al. | 91/300 |
| 4,034,817 | 7/1977 | Okada | 173/134 |

*Primary Examiner*—Robert A. Hafer

*Attorney, Agent, or Firm*—Watson, Cole, Grindle & Watson

[57] ABSTRACT

A reciprocating hydraulic motor, for example for a rotary percussive drilling head, includes a piston and cylinder having a piston face exposed to the pressure in a compression chamber which is connected through ports controlled by the piston to a supply pressure at one end portion of its stroke, and to exhaust at an opposite end portion of the stroke, while between these end portions of the stroke is a compression/expansion travel during which the compression chamber is closed and the liquid in it alternately expands over a higher range of pressure and is compressed over a lower range of pressure.

For returning the piston, in the direction in which liquid is compressed, one of two opposed faces of the piston is exposed to the pressure in a biasing chamber which communicates permanently with a constant pressure supply while the other communicates with the compression chamber.

10 Claims, 3 Drawing Figures

RECIPROCATING HYDRAULIC MOTORS

Figure 1:
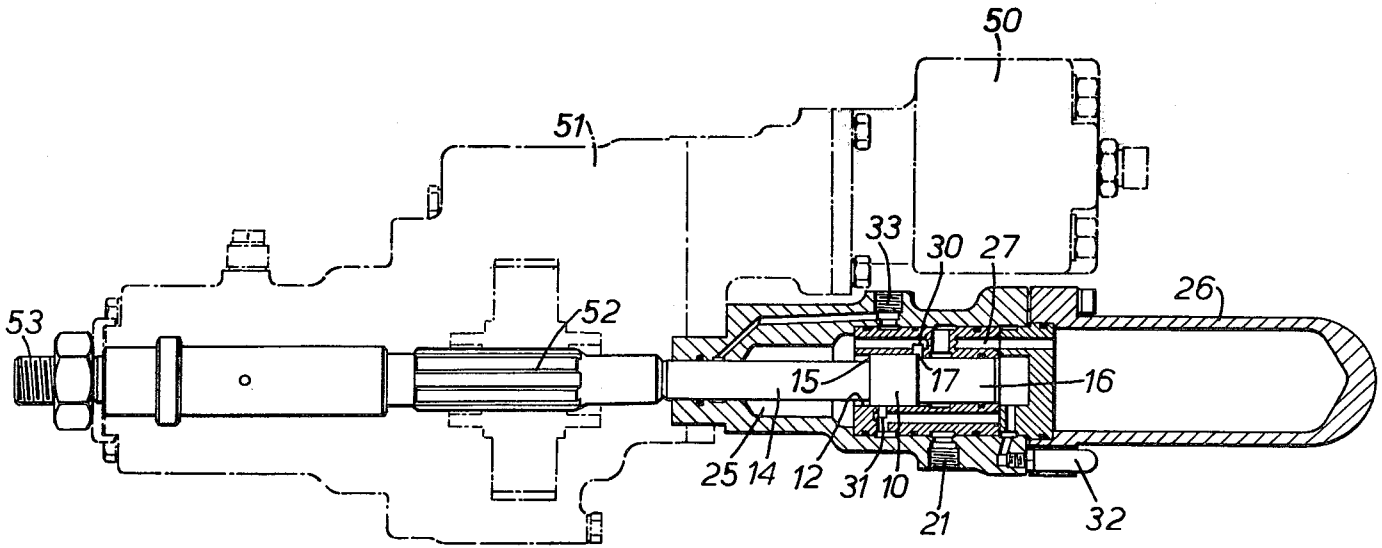

This invention relates to reciprocating hydraulic motors and is concerned with providing a simple and efficient form of motor. In general reciprocating hydraulic motors for percussive machines have employed separate valves but these involve complications and can cause trouble in operation. It has therefore been proposed to employ a motor which has no valves and in which the supply of liquid is controlled by ports controlled by the piston. Such constructions have in general either been unduly complicated or unreliable or inefficient. An object of the invention is to provide a simple and efficient arrangement bearing in mind that in general there is a theoretical limit to the efficiency of such a motor.

According to the present invention a reciprocating hydraulic motor includes a piston and cylinder having a piston face exposed to the pressure in a compression chamber which is connected through ports controlled by the piston to a supply pressure at one end portion of its stroke, and to exhaust at an opposite end portion of the stroke, while between these end portions of the stroke, is a compression/expansion travel during which the compression chamber is closed and the liquid in it alternately expands over a higher range of pressure and is compressed over a lower range of pressure.

The term "exhaust" used herein is not intended to mean that the pressure is atmospheric. For example the exhaust from the reciprocating motor could be used to drive a rotary motor for a rotary percussive drilling head.

It will, of course be necessary to provide means for returning the piston in the direction in which the liquid in the compression chamber is compressed. This may be done by means of an air cushion or a spring, or by duplicating the arrangement so that the piston is double-acting. Preferably, however, for simplicity, it is done by applying the supply pressure to an opposite face of the piston.

Thus, in one form of the invention the piston has opposed faces one of which is exposed to a pressure in a biasing chamber which communicates permanently with a constant pressure supply, while the other communicates with the compression chamber.

Preferably the pressure from a common pressure supply is applied to both the biasing chamber and the compression chamber. In this case the effective piston area exposed to the compression chamber will be greater than that exposed to the biasing chamber, for example about double.

It can be shown by calculation that a desirable value for the volume of the compression chamber is twice the effective bulk modulus of the liquid multiplied by the swept volume of the piston face exposed to the pressure in the compression chamber and divided by the supply pressure. In practice this may be not less than about a hundred times the swept volume of the piston face exposed to the pressure in the compression chamber.

The overlap of the ports may be designed so that the pressure rise during the compression portion of the cycle, and the pressure fall during the expansion portion, are about half the difference between the supply pressure and the exhaust pressure.

The invention is particularly applicable to reciprocating motors for precussive tools in which case the piston will be combined with a hammer.

In one form of the invention the hammer strikes a tool at the end of the piston beyond the compression chamber so that the impact occurs at the end of a stroke during which the compression chamber is contracting.

In an alternative arrangement the motor is in effect inverted end to end and the impact occurs at the end of a working stroke during which the compression chamber is increasing in volume. In the former case the travel of the piston from its rearmost position to the closing of the exhaust port is substantially greater than its travel while the pressure port is open and the impact occurs.

The invention is particularly, although not exclusively applicable to a rotary percussive drilling head. In such an application the percussive action is often only required for unusually difficult conditions and hence it is particularly desirable that the motor producing percussive action should be as simple and inexpensive as possible.

Figure 2:
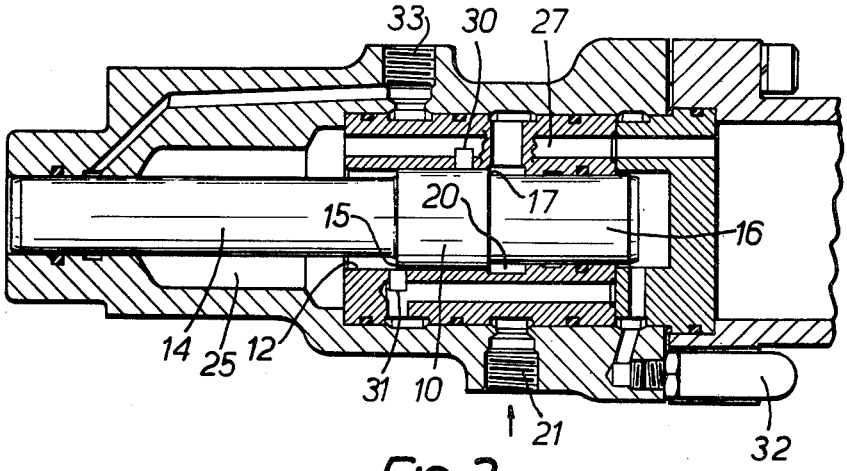
Figure 3:
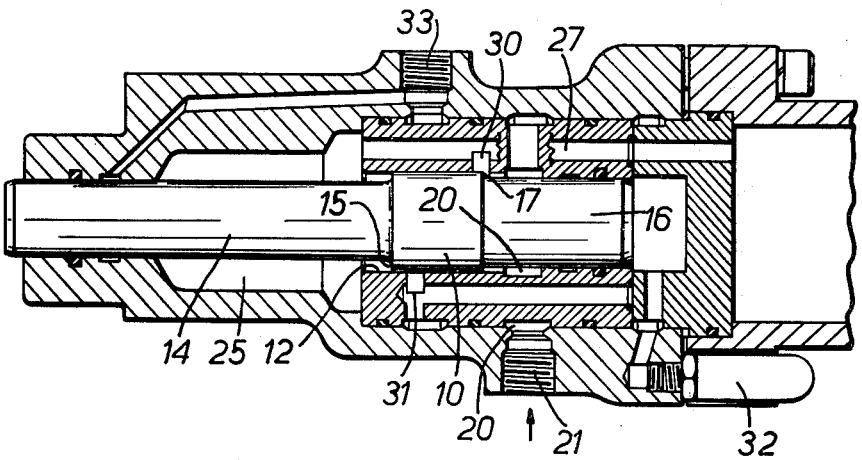

The invention may be put into practice in various ways but one specific embodiment will be briefly described by way of example, with reference to the accompanying drawings in which:

FIG. 1 is a side view of a reciprocating hydraulic motor shown in longitudinal section applied to a rotary percussive tool, shown in outline in chain lines, and FIGS. 2 and 3 are enlarged views of parts of FIG. 1 showing the piston in different positions.

The motor comprises a piston 10 fitting in a cylinder 12 and merging at one end, which will be termed the forward end, with a front piston rod 14, and at the rear end with a rear piston rod 16. The piston and the two piston rods together constitute a hammer which at its forward end strikes a tool at a high frequency such as 100 Herz. The diameter of the front piston rod is slightly less than that of the piston, whilst the diameter of the rear piston rod has an intermediate value so that the front effective annular face 15 of the piston is about double the rear effective annular face 17 of the piston.

The annular rear face of the piston is permanently in communication with a biasing chamber 20 communicating through a connection 21 with a supply of liquid under pressure, for example of the order of 100 bars.

The front annular face 15 of the piston is open to a compression chamber having a volume many times that swept out by the annular piston face 15. The compression chamber has a front portion 25 surrounding the front piston rod and a rear portion 26 communicating with the front portion through longitudinal bores 27.

The ends of the piston controls annular ports in the cylinder. Thus the rear end of the piston controls a pressure port 30 connecting the compression chamber through generous longitudinal bores 27 to the biasing chamber 20 and hence to the pressure supply 21. The front end of the piston controls an exhaust port 31 communicating with the tank through a coupling 33 so as to exhaust the compression chamber.

The rear face of the rear piston rod 16 is exposed to atmospheric pressure through a combined silencer and microporous plastics filter 32.

Accordingly, the operation is as follows. Starting with the piston 10 in its rearmost position shown in FIG. 2 the exhaust port 31 is open connecting the compression chamber 25, 26 and hence the front end 15 of the piston, with the tank, while the supply pressure is applied to the small rear annular face 17 of the piston so as to drive it forward. At a certain point in the forward travel of the piston its front edge closes the exhaust port so that the compression chamber is isolated and the liquid in it is compressed and its pressure rises from that of the exhaust pressure to an intermediate value. At the end of this portion of the stroke, which can be referred to as compression/expansion travel, the rear end of the piston opens the pressure port as shown in FIG. 3 and admits supply pressure from the supply 21 via the biasing chamber 20 to the compression chamber 25, 26 so that the pressure in the latter rapidly rises to that of the supply.

From this point further forward movement of the piston is opposed by the supply pressure acting rearwardly on the front annular face 15 of the piston which is bigger than the rear annular face 17 upon which it also acts. After travelling a short distance under these conditions the hammer strikes the tool and is decelerated while imparting its energy to the tool.

The piston then starts its return movement under the action of the supply pressure acting upon the larger front face 15 of the piston and the smaller rear face 17. After a short rearward travel the rear edge of the piston closes the pressure port 30 so that again the compression chamber is isolated and the liquid in it expands from the supply pressure down to an intermediate pressure.

At a further point of the return stroke, the front end of the piston opens the exhaust port 31 so that the pressure in the compression chamber rapidly falls to the exhaust pressure. For the rest of the return stroke the exhaust pressure is acting on the forward face 15 of the piston while the supply pressure is acting on the rearward face 17 and hence acting as a buffer to decelerate the piston. When the piston reaches its rearmost position the cycle is complete and will be repeated as described.

As indicated above the reciprocating motor described is particularly applicable to a rotary percussive drifting head, and FIG. 1 shows it so applied to a rotary percussive drilling head shown in outline. The drilling head comprises a hydraulic rotary motor 50, a reduction gearbox 51, arranged to rotate a splined tool 52 which receives the impacts of the piston 10, and at its forward end is provided with a connection 53 to a drill rod. These parts may be of conventional construction and it is thought unnecessary to describe them in detail.

In an alternative arrangement, not illustrated, the construction is generally as described above but turned virtually end to end, so that the impact with the tool occurs at the end of the stroke produced by the supply pressure acting on the larger face of the piston and on the smaller face, instead of at the end of the stroke produced by the supply pressure acting on the smaller face of the piston while the larger face is exposed to exhaust pressure. Each arrangement has its advantages; the arrangement first described, and shown in the drawings, may tend towards more convenient connections of the flow and return hoses, whereas the modified arrangment may facilitate the incorporation of front-end cushioning.

The arrangement such as that shown in the drawings, with the major part of the compression chamber at the rear end, has the advantages that a chamber of adequate size (say not less than a hundred and typically about one hundred and thirty times the swept volume of the smaller piston face) can be conveniently accommodated, and also that alternative compression chambers can be fitted to an otherwise standard stool, e.g. to suit a change of supply pressure or of liquid.

What we claim as our invention and desire to secure by Letters Patent is:

1. A reciprocating hydraulic motor including a cylinder, a piston mounted to reciprocate in the cylinder and having opposed faces exposed respectively to the pressure in a compression chamber and the pressure in a biasing chamber communicating permanently with a constant supply pressure so that reciproction of the piston alternately increases the biasing chamber and vice versa, and means defining ports controlled by the piston to connect the compression chamber directly to a pressure supply throughout one end portion of a stroke, and to connect the compression chamber directly to exhaust throughout an opposite end portion of the stroke, and throughout a compression-expansion travel between these end portions to cut off the compression chamber from all external connection so that the liquid in it alternately expands over a higher range of pressure and is compressed over a lower range of pressure.

2. A motor as claimed in claim 1 in which the pressure from a common pressure supply is applied to both the biasing chamber and the compression chamber.

3. A motor as claimed in claim 2 in which the effective piston area exposed to the compression chamber is greater than that exposed to the biasing chamber.

4. A motor as claimed in claim 1 in which the volume of the compression chamber is about twice the effective bulk modulus of the liquid multiplied by the swept volume of the piston face exposed to the pressure in the compression chamber and divided by the supply pressure.

5. A motor as claimed in claim 4 in which the volume of the compression chamber is not less than about 100 times the swept volume of the piston face exposed to the pressure in it.

6. A motor as claimed in claim 1 in which the relative positions of the ports are such that the rise of pressure during the compression portion of the cycle and the fall of pressure during the expansion portion are about half the difference between the supply pressure and the exhaust pressure.

7. A percussive tool incorporating a motor as claimed in claim 1 in which the piston is combined with a hammer.

8. A rotary percussive tool claimed in claim 7 including a drilling head and means for rotating the drill while delivering impacts to it from the hammer.

9. A percussive tool as claimed in claim 8 in which the hammer strikes a tool at the end of a stroke during which the compression chamber is contracting.

10. A percussive tool as claimed in claim 8 in which the hammer strikes a tool at the end of a stroke during which the compression chamber is expanding.

* * * * *

UNITED STATES PATENT OFFICE

CERTIFICATE OF CORRECTION

PATENT NO. : 4,161,989

DATED : July 24, 1979

INVENTOR(S) : Anthony D. Barber

It is certified that error appears in the above-identified patent and that said Letters Patent are hereby corrected as shown below:

In the title page under "Foreign Priority Data", delete "August 10, 1976" and insert -- October 8, 1976--.

Signed and Sealed this

*Eighth* Day of *January 1980*

[SEAL]

*Attest:*

SIDNEY A. DIAMOND

*Attesting Officer*

*Commissioner of Patents and Trademarks*